US006412119B1

(12) United States Patent
Robles

(10) Patent No.: US 6,412,119 B1
(45) Date of Patent: Jul. 2, 2002

(54) UNDERGARMENT WITH OPENABLE FORWARD FLAP

(76) Inventor: Jose Robles, 1015 Walnut Ave., Long Beach, CA (US) 90813

( * ) Notice: Subject to any disclaimer, the term of this patent is extended or adjusted under 35 U.S.C. 154(b) by 0 days.

(21) Appl. No.: 10/015,297

(22) Filed: Dec. 12, 2001

(51) Int. Cl.[7] ..... A41B 9/04
(52) U.S. Cl. ..... 2/400; 2/406; 2/408; 2/405
(58) Field of Search ..... 2/400–408, 409; 450/102, 103, 104, 105; 604/395

(56) References Cited

U.S. PATENT DOCUMENTS 1,126,765 A * 2/1915 Hynds ..... 2/400
2,638,900 A * 5/1953 Gruenberg et al. ..... 2/400
2,726,396 A * 12/1955 Rosenberg ..... 2/400
3,207,155 A * 9/1965 Casey ..... 2/403
3,974,836 A * 8/1976 Carlson ..... 2/406
4,597,110 A * 7/1986 Smith, Sr. et al. ..... 2/408
4,637,078 A * 1/1987 Southwell ..... 2/408
4,675,918 A * 6/1987 O'Brien ..... 2/402
4,835,795 A * 6/1989 Lonon ..... 2/408
5,711,034 A * 1/1998 Cillik ..... 2/406
5,930,838 A * 8/1999 Carter-Scott-Pomije .... 2/400 X
6,324,699 B1 * 12/2001 Cosmah ..... 2/239

* cited by examiner

*Primary Examiner*—Gloria M. Hale
(74) *Attorney, Agent, or Firm*—Goldstein & Lavas, P.C.

(57) ABSTRACT

An undergarment with openable forward flap including a pair of underpants adapted for being worn by a person. The underpants have a central opening therethrough. The central opening is aligned with genitalia of the person when the pair of underpants are being worn. A flap portion is removably disposed over the central opening of the pair of underpants.

2 Claims, 1 Drawing Sheet

UNDERGARMENT WITH OPENABLE FORWARD FLAP

BACKGROUND OF THE INVENTION

The present invention relates to an undergarment with openable forward flap and more particularly pertains to allowing easy access to one's genitalia.

The use of undergarment assemblies is known in the prior art. More specifically, undergarment assemblies heretofore devised and utilized for the purpose of facilitating urination are known to consist basically of familiar, expected and obvious structural configurations, notwithstanding the myriad of designs encompassed by the crowded prior art which have been developed for the fulfillment of countless objectives and requirements.

By way of example, U.S. Pat. No. 6,014,777 to Gupton discloses an undergarment with a VELCRO™ closure, for medical purposes. U.S. Pat. No. 5,630,232 to Miller discloses an undergarment with a linear fly opening, covered by a pair of flaps. U.S. Pat. No. 5,093,935 to Countee, Jr. discloses an undergarment with a pocket incorporated.

While these devices fulfill their respective, particular objective and requirements, the aforementioned patents do not describe an undergarment with an openable forward flap for allowing easy access to one's genitalia.

In this respect, the undergarment with openable forward flap according to the present invention substantially departs from the conventional concepts and designs of the prior art, and in doing so provides an apparatus primarily developed for the purpose of allowing easy access to one's genitalia.

Therefore, it can be appreciated that there exists a continuing need for a new and improved undergarment with openable forward flap which can be used for allowing easy access to one's genitalia. In this regard, the present invention substantially fulfills this need.

SUMMARY OF THE INVENTION

In the view of the foregoing disadvantages inherent in the known types of undergarment assemblies now present in the prior art, the present invention provides an improved undergarment with openable forward flap. As such, the general purpose of the present invention, which will be described subsequently in greater detail, is to provide a new and improved undergarment with openable forward flap which has all the advantages of the prior art and none of the disadvantages.

To attain this, the present invention essentially comprises a pair of underpants adapted for being worn by a person. The underpants have a waistband, a front panel, a back panel, and a pair of leg openings. The front panel has a central opening therethrough. The central opening is aligned with genitalia of the person when the pair of underpants are being worn. The central opening has a layer of adhesive disposed around a periphery thereof. A flap portion is removably disposed over the central opening of the pair of underpants. The flap portion has a layer of adhesive disposed around a periphery thereof. The flap portion is engaged within the central opening for the covering thereof whereby the layer adhesive of the central opening engages the layer of adhesive of the flap portion. The flap portion has a handle extending upwardly therefrom.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved undergarment with openable forward flap which has all the advantages of the prior art undergarment assemblies and none of the disadvantages.

It is another object of the present invention to provide a new and improved undergarment with openable forward flap which may be easily and efficiently manufactured and marketed.

It is a further object of the present invention to provide a new and improved undergarment with openable forward flap which is of durable and reliable construction.

An even further object of the present invention is to provide a new and improved undergarment with openable forward flap which is susceptible of a low cost of manufacture with regard to both materials and labor, and which accordingly is then susceptible of low prices of sale to the consuming public, thereby making such an undergarment with openable forward flap economically available to the buying public.

Even still another object of the present invention is to provide a new and improved undergarment with openable forward flap for allowing easy access to one's genitalia.

Lastly, it is an object of the present invention to provide a new and improved undergarment with openable forward flap including a pair of underpants adapted for being worn by a person. The underpants have a central opening therethrough. The central opening is aligned with genitalia of the person when the pair of underpants are being worn. A flap portion is removably disposed over the central opening of the pair of underpants.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
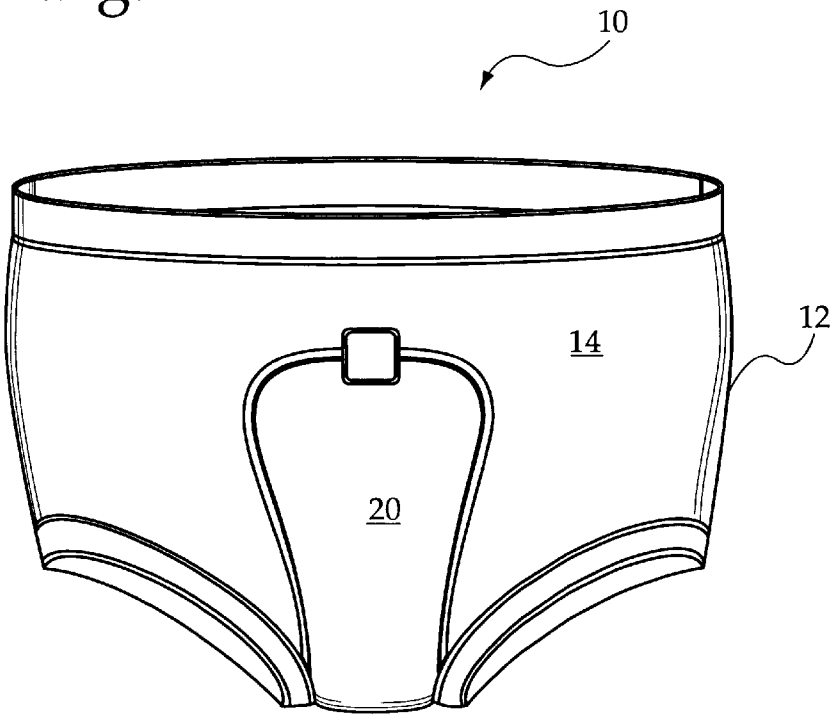
FIG. 1 is a front view of the preferred embodiment of the undergarment with openable forward flap constructed in accordance with the principles of the present invention.
Figure 2:
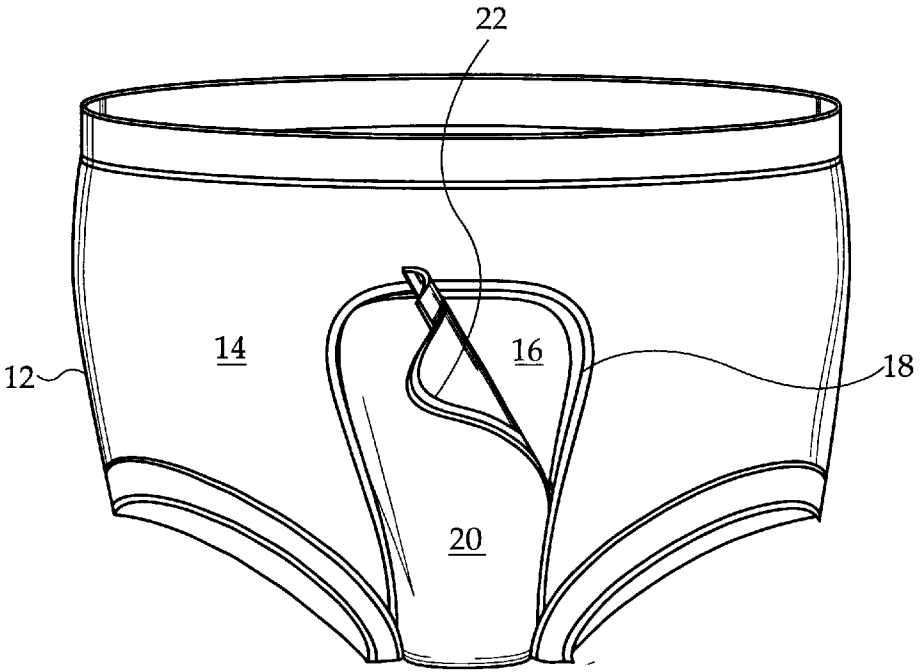
FIG. 2 is a front view of the present invention illustrating use of the flap portion thereof.

With reference now to the drawings, and in particular, to FIGS. 1 and 2 thereof, the preferred embodiment of the new and improved undergarment with openable forward flap embodying the principles and concepts of the present invention and generally designated by the reference number 10 will be described.

Specifically, it will be noted in the various Figures that the device relates to an undergarment with openable forward flap for allowing easy access to one's genitalia. In its broadest context, the device consists of a pair of underpants and a flap portion. Such components are individually configured and correlated with respect to each other so as to attain the desired objective.

The pair of underpants 12 are adapted for being worn by a person. The underpants 12 have a waistband, a front panel 14, a back panel, and a pair of leg openings. The front panel 14 has a central opening 16 therethrough. The central opening 16 is aligned with genitalia of the person when the pair of underpants 12 are being worn. The central opening 16 has a layer of adhesive 18 disposed around a periphery thereof. The central opening 16 has generally hourglass shape whereby its upper portion is larger in width than its lower portion.

The flap portion 20 is removably disposed over the central opening 16 of the pair of underpants 12. The flap portion 20 has a layer of adhesive 22 disposed around a periphery thereof. The flap portion 20 is engaged within the central opening 16 for the covering thereof whereby the layer of adhesive 18 of the central opening 16 engages the layer of adhesive 22 of the flap portion 20. The flap portion 20 has a handle 24 extending upwardly therefrom. The handle 24 allows the wearer of the present invention to easily manipulate the flap portion 20. The shape of the flap portion 20 conforms with the shape of the central opening 16.

In use, the present invention allows a man or boy easy access to their penis in order to use the bathroom. The user simply pulls outwardly on the handle 24 to separate the flap portion 20 from the central opening 16 thereby exposing the genitalia's area.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An undergarment with an openable forward flap for allowing easy access to one's genitalia comprising, in combination:

a pair of underpants adapted for being worn by a person, the underpants having a waistband, a front panel, a back panel, and a pair of leg openings, the front panel having a central opening therethrough, the central opening being aligned with genitalia of the person when the pair of underpants are being worn, the central opening having a layer of adhesive disposed around a periphery thereof; and a flap portion removably disposed over the central opening of the pair of underpants, the flap portion having a layer of adhesive disposed around a periphery thereof, the flap portion being engaged within the central opening for covering thereof whereby the layer of adhesive of the central opening engages the layer of adhesive of the flap portion, the flap portion having a handle extending upwardly therefrom.

2. An undergarment with an openable forward flap for allowing easy access to one's genitalia comprising, in combination:

a pair of underpants adapted for being worn by a person, the underpants having a central opening therethrough, the central opening being aligned with genitalia of the person when the pair of underpants are being worn; and a flap portion removably disposed over the central opening of the pair of underpants, the flap portion being engaged within the central opening for covering thereof, said flap portion having a handle extending upwardly therefrom.

* * * * *